US008749465B2

(12) United States Patent
Ho et al.

(10) Patent No.: US 8,749,465 B2
(45) Date of Patent: Jun. 10, 2014

(54) METHOD AND SYSTEM FOR DRIVING AN ACTIVE MATRIX DISPLAY DEVICE

(75) Inventors: Yu-Hsi Ho, Kaohsiung (TW); Wen-Chieh Chang, Caotun Township, Nantou County (TW); Fang-Yu Su, Huwei Township, Yunlin County (TW); Yao-Jen Hsieh, Taichung (TW)

(73) Assignee: AU Optronics Corporation, Hsinchu (TW)

( * ) Notice: Subject to any disclaimer, the term of this patent is extended or adjusted under 35 U.S.C. 154(b) by 1418 days.

(21) Appl. No.: 11/605,589

(22) Filed: Nov. 29, 2006

(65) Prior Publication Data

US 2007/0120801 A1 May 31, 2007

Related U.S. Application Data

(60) Provisional application No. 60/741,220, filed on Nov. 30, 2005.

(51) Int. Cl.
*G09G 3/36* (2006.01)

(52) U.S. Cl.
USPC ..... 345/94; 345/98

(58) Field of Classification Search
USPC ..... 345/98–99, 208, 210, 214–215, 90, 345/94–95; 315/169.2
See application file for complete search history.

(56) References Cited

U.S. PATENT DOCUMENTS

| | | | | |
|---|---|---|---|---|
| 6,020,870 | A * | 2/2000 | Takahashi et al. | 345/92 |
| 6,870,530 | B2 * | 3/2005 | Bu et al. | 345/208 |
| 6,903,716 | B2 | 6/2005 | Kawabe et al. | 345/99 |
| 6,961,043 | B2 | 11/2005 | Saishu et al. | 345/96 |
| 7,522,134 | B2 * | 4/2009 | Mizumaki | 345/87 |
| 2002/0015017 | A1 * | 2/2002 | Kwag | 345/89 |
| 2002/0033789 | A1 * | 3/2002 | Miyata et al. | 345/89 |
| 2002/0158857 | A1 * | 10/2002 | Iisaka | 345/204 |
| 2003/0030605 | A1 | 2/2003 | Chen et al. | |
| 2003/0156092 | A1 * | 8/2003 | Suzuki et al. | 345/98 |
| 2005/0200589 | A1 * | 9/2005 | Takatori | 345/98 |

FOREIGN PATENT DOCUMENTS

| | | |
|---|---|---|
| CN | 1632854 | 6/2005 |
| TW | I235981 | 7/2005 |

* cited by examiner

*Primary Examiner* — Jonathan Horner

(57) ABSTRACT

A method for driving an active matrix display wherein each image frame is divided into a number of displayed frame portions, each of which is followed by a darker frame portion. The image data in the darker frame portion is removed so as to allow the pixel luminance to diminish. The temporal separation between the displayed frame portion and the following darker frame portion is smaller than a frame time. In a display where the lines are driven repetitively for forming the display image in a plurality of frame times, the image data provided to a pixel, after the luminance in that pixel changes from low to high, is adjusted so that the brightness of the pixel in the preceding frame times appear higher or not lower than that in following frames times.

9 Claims, 12 Drawing Sheets

METHOD AND SYSTEM FOR DRIVING AN ACTIVE MATRIX DISPLAY DEVICE

This patent application is based on and claims priority to U.S. patent application Ser. No. 60/741,220, filed Nov. 30, 2005, and assigned to the assignee of the present invention.

FIELD OF THE INVENTION

The present invention relates generally to an active-matrix display device and, more particularly, to a method for driving such display device.

BACKGROUND OF THE INVENTION

An active matrix display device, such as an active-matrix liquid crystal display (AMLCD) panel, has a two-dimensional pixel array comprising a plurality of pixel rows. Each of the pixel rows has a plurality of pixels arranged in the x direction, as shown in FIG. 1. These pixel rows are arranged as lines in the y direction so that they can be sequentially driven by a plurality of scanning signals provided in the scanning lines by one or more scanning circuits. In FIG. 1, the display panel 10 has a display area 20 comprising of pixels 22. Each pixel row is driven by a gate line Gn provided by a scanning circuit or gate line driver 40. The data signal to the pixel rows are provided in a plurality of data lines Dn by a source driver or data IC 30.

In a liquid crystal display panel, due to the response time of the liquid crystal, sometimes an effect known as motion blur occurs in a sequence of animated pictures. Many attempts have been made to reduce or eliminate this artifact. One of the techniques for reducing the motion blur effect is to shorten the response time by overdriving the liquid crystal. Another technique is the black frame insertion technique wherein "blanking data" in one or more frames are provided to the display panel after an image frame has been displayed. Some of the prior art solutions to the motion blur effect have certain undesirable artifacts such as ghost image and double-edge image.

It is desirable and advantageous to provide a method and system for reducing the motion blur effect in an active-matrix display device.

SUMMARY OF THE INVENTION

The present invention provides a driving method wherein each image frame is divided into a number of displayed frame portions. Each portion is followed by darker frame portion. The temporal separation between the displayed frame portion and the following darker frame portion is smaller than a frame time. This means that within a frame, the data of the displayed image on a pixel in the displayed frame portion is only provided to the pixel for a portion of a frame time. For the remaining time in the same frame, the data is removed so as to allow the pixel luminance to diminish.

In a display where pixels are arranged in a plurality of lines and the lines are driven repetitively for forming the display image in a plurality of frame times, the plurality of frame times are divided into a first group of frame times and a following second group of frame times. If the total luminance in the pixels in the first group is lower than the total luminance in the pixels in the second group, the image data provided to the first group of frame times is adjusted so as to increase the total luminance in the first group of frame times.

Alternatively, at least the first period in the first group of frame times is lengthened so as to increase the total luminance in said pixels in the first group of frame times.

Alternatively, the charging time in the first period in the first group of frame times is adjusted so as to increase the total luminance in said pixels in the first group of frame times.

In another embodiment, where the luminance in the first period has a maximum luminance and the luminance in the second period has a minimum luminance, and the maximum value in said pixels in the first group is lower than the luminance in said pixels in the second group, the image data provided to the pixels in the first group of frame times is adjusted so as to increase the maximum luminance in the pixels in the first group of frame times.

Alternatively, the image data provided to the pixels in the first group of frame times is adjusted so as to decrease the minimum luminance in said pixels in the first group of frame times.

Alternatively, the charging time in the first period in the first group of frame times is adjusted so as to increase the maximum luminance in said pixels in the first group of frame times.

DETAILED DESCRIPTION OF THE INVENTION

The driving method, according to the present invention, divides each image frame into one or more displayed frame portions, each displayed frame portion is followed by a darker frame portion. The temporal separation between the displayed frame portion and the corresponding darker frame portion is smaller than a frame time. This means that within a frame, the data of the displayed image on a pixel in each displayed time portion is only provided to the pixel for a portion of a frame time. The data is then removed so as to allow the pixel luminance to diminish for the remaining time in the same frame.

Figure 1:
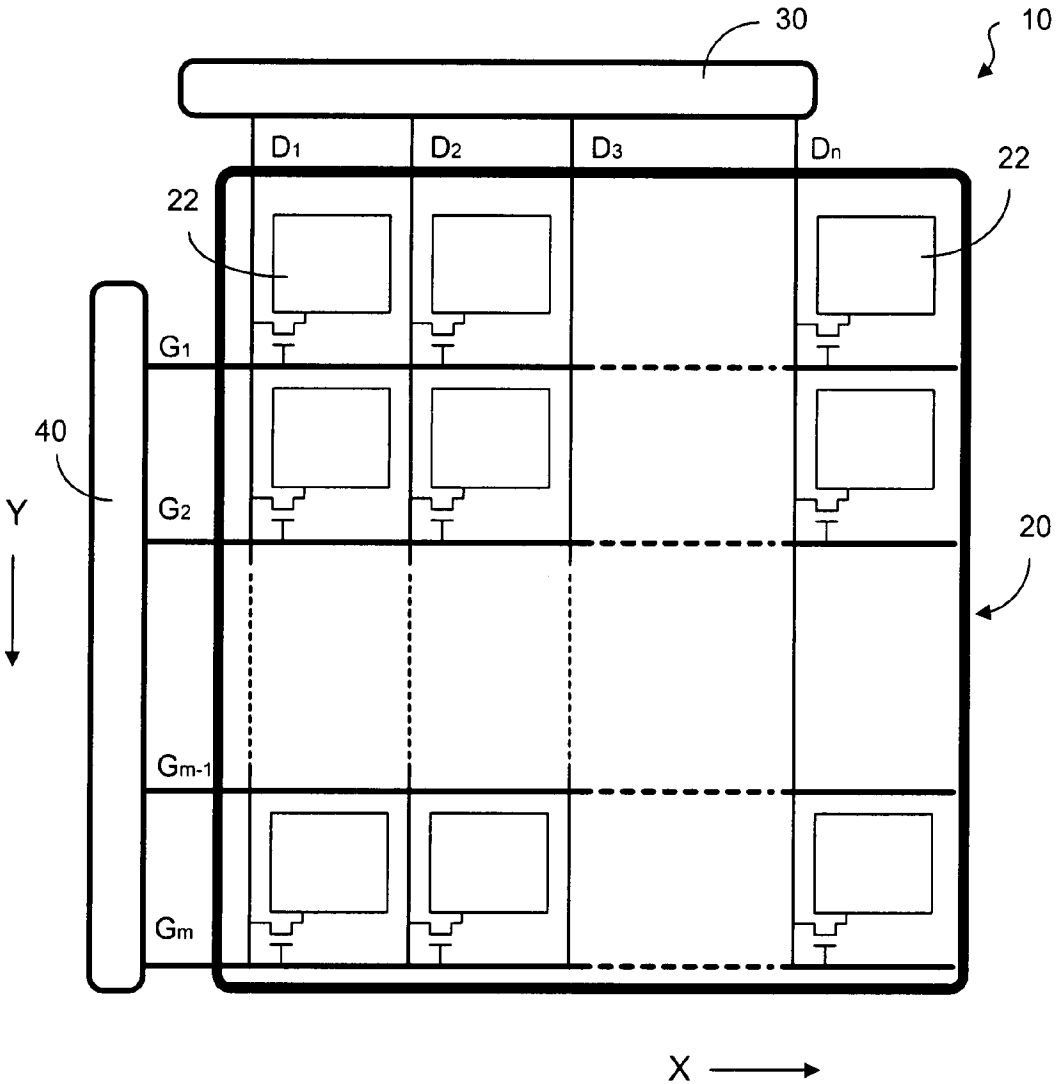
FIG. 1 (prior art)
FIG. 1 is a schematic representation of a display panel having a two-dimensional pixel array.
Figure 2:
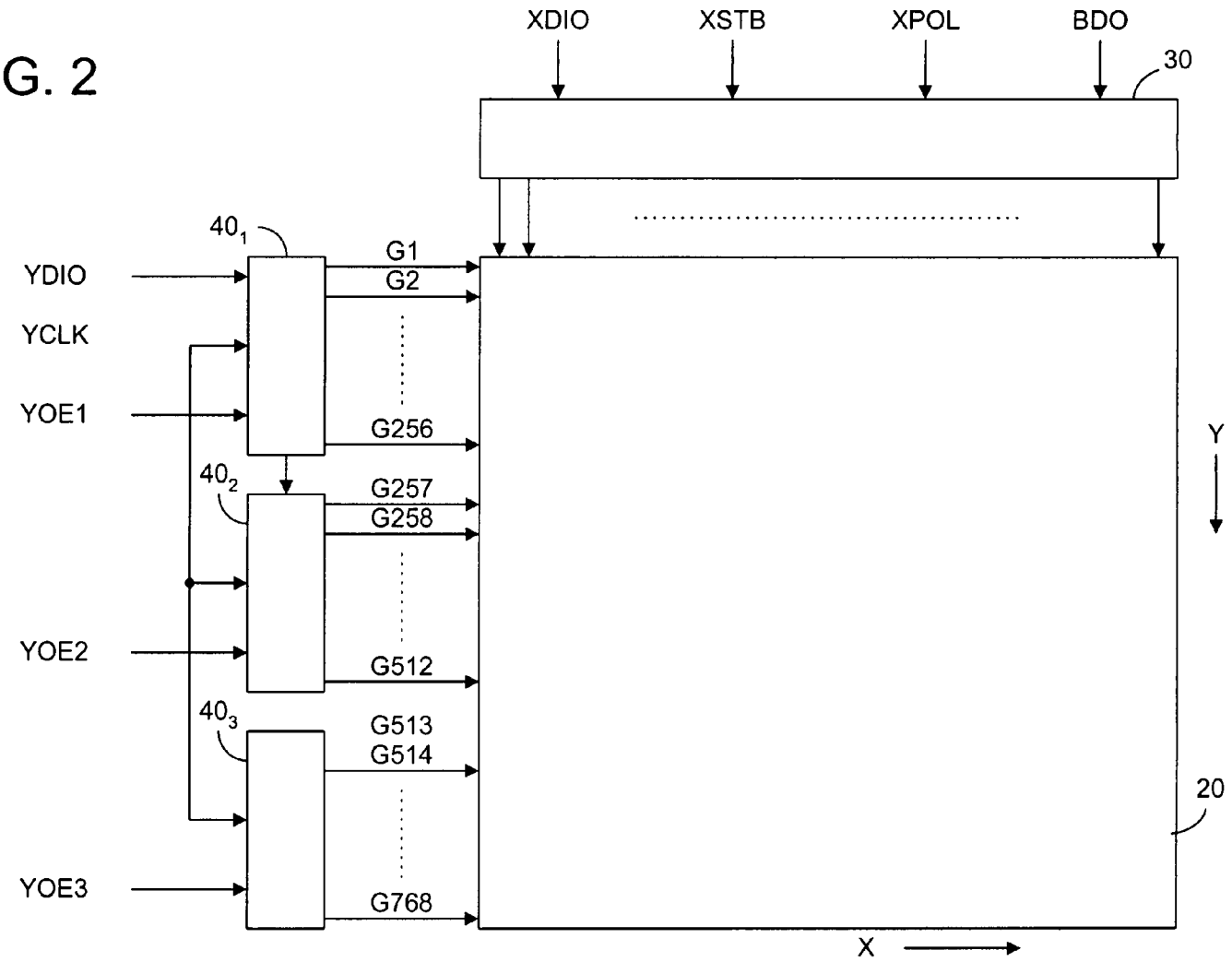
FIG. 2 is a block diagram showing the driving arrangement in a display panel, according to the present invention.

In an exemplary embodiment of the present invention, each image frame is divided into three displayed frame portions, each followed by a darker frame portion. The temporal separation between a displayed frame portion and the corresponding darker frame portion is substantially equal to half a frame time. However, this temporal separation can be adjusted. The driving arrangement of the display panel, according to this embodiment of the present invention, is shown in FIG. 2. It is assumed that the display panel has a resolution of 1366×768, for example. In order to provide scanning signals to the 768 gate lines, three gate line drivers $\mathbf{40}_1$, $\mathbf{40}_2$ and $\mathbf{40}_3$ are used to separately drive three groups of gate lines. As shown, gate line driver $\mathbf{40}_1$, is used to drive the group of gate lines G1 to G256, gate line driver $\mathbf{40}_2$ is used to drive the group of gate lines G257 to G512 and gate line driver $\mathbf{40}_3$ is used to drive the group of gate lines G513 to G768. The gate line drivers $\mathbf{40}_1$, $\mathbf{40}_2$ and $\mathbf{40}_3$ are arranged in a cascaded manner to be separately controlled by control signals YOE1, YOE2 and YOE3.

In FIG. 2, YDIO is used to provide a signal for starting the scanning of a frame. XDIO is used to provide a signal for synchronizing the scanning in each line. YCLK denotes the clock signals. XSTB, XPOL and BDO are control signals associated with the lines. These signals will be described in conjunction with FIGS. 3-5.

Figure 3:
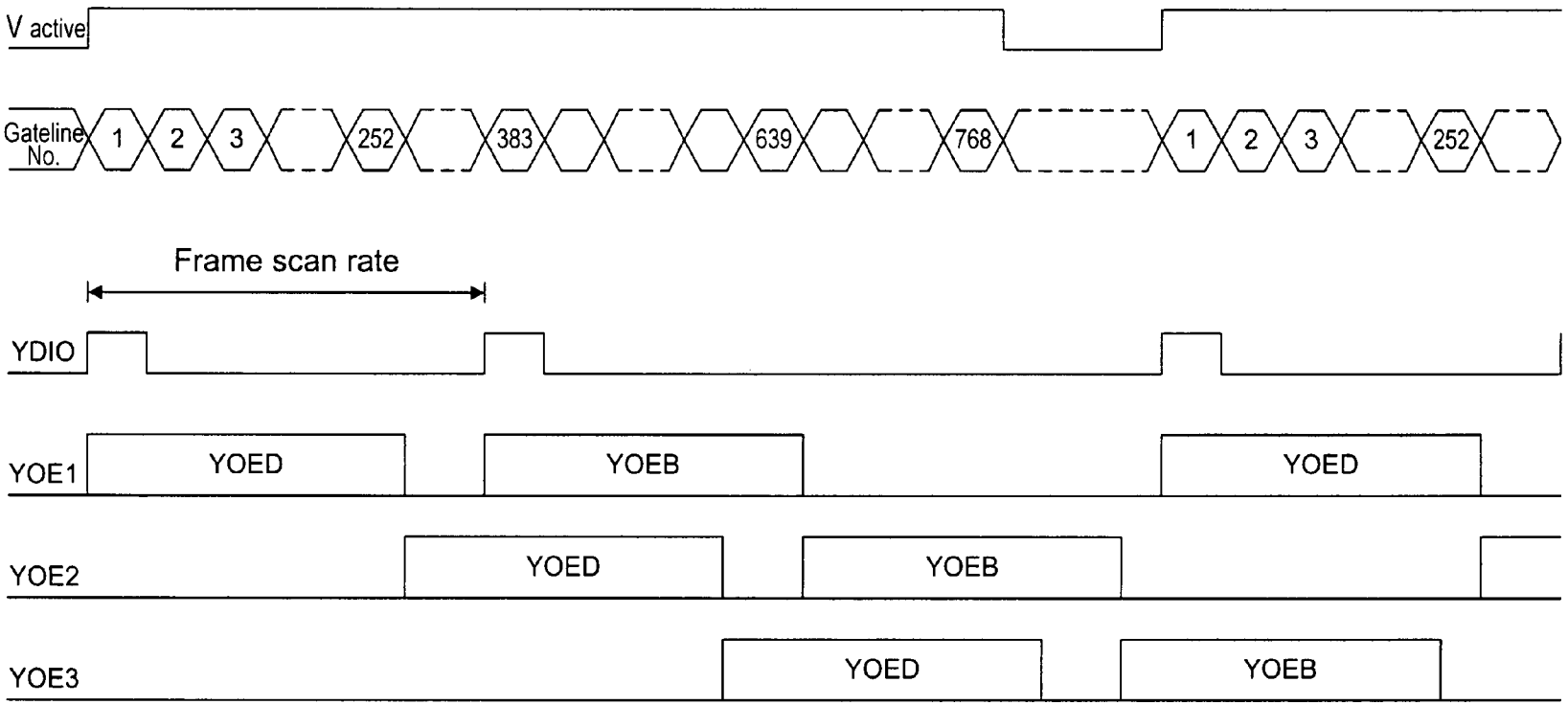
FIG. 3 is a timing chart showing the partition of the lines in a frame into a plurality of displayed frame portions and their associated darker frame portions.

In FIG. 3, $V_{active}$ denotes the active period within a frame time. Within a frame time, YDIO provides a signal to gate line G1 for starting the scanning of a frame. YDIO also provides a signal to gate line G383. This second YDIO signal is also referred to as the VT-YDIO signal (see FIG. 6). These gate line signals determine the frame scan rate. Within a frame time, the time periods for three displayed frame portions are represented by YOEDs in the YOE1, YOE2 and YOE3 control signals. The darker frame portions separately following the three displayed frame portions are represented by YOEBs in the YOE1, YOE2 and YOE3 control signals. It should be noted that each YOED comprises a sequence of pulses for enabling the charging of pixels in a corresponding group of lines and each YOEB comprises a sequence of pulses for starting the discharging of the pixels. The sequence of pulses in YOEB lags behind the sequence of pulses in YOED in the same YOEN (N=1 to 3) control signal by the period of 252 lines. The temporal relationship between each pulse in the YOED and the corresponding pulse in YOED is shown in FIG. 4.

Figure 4:
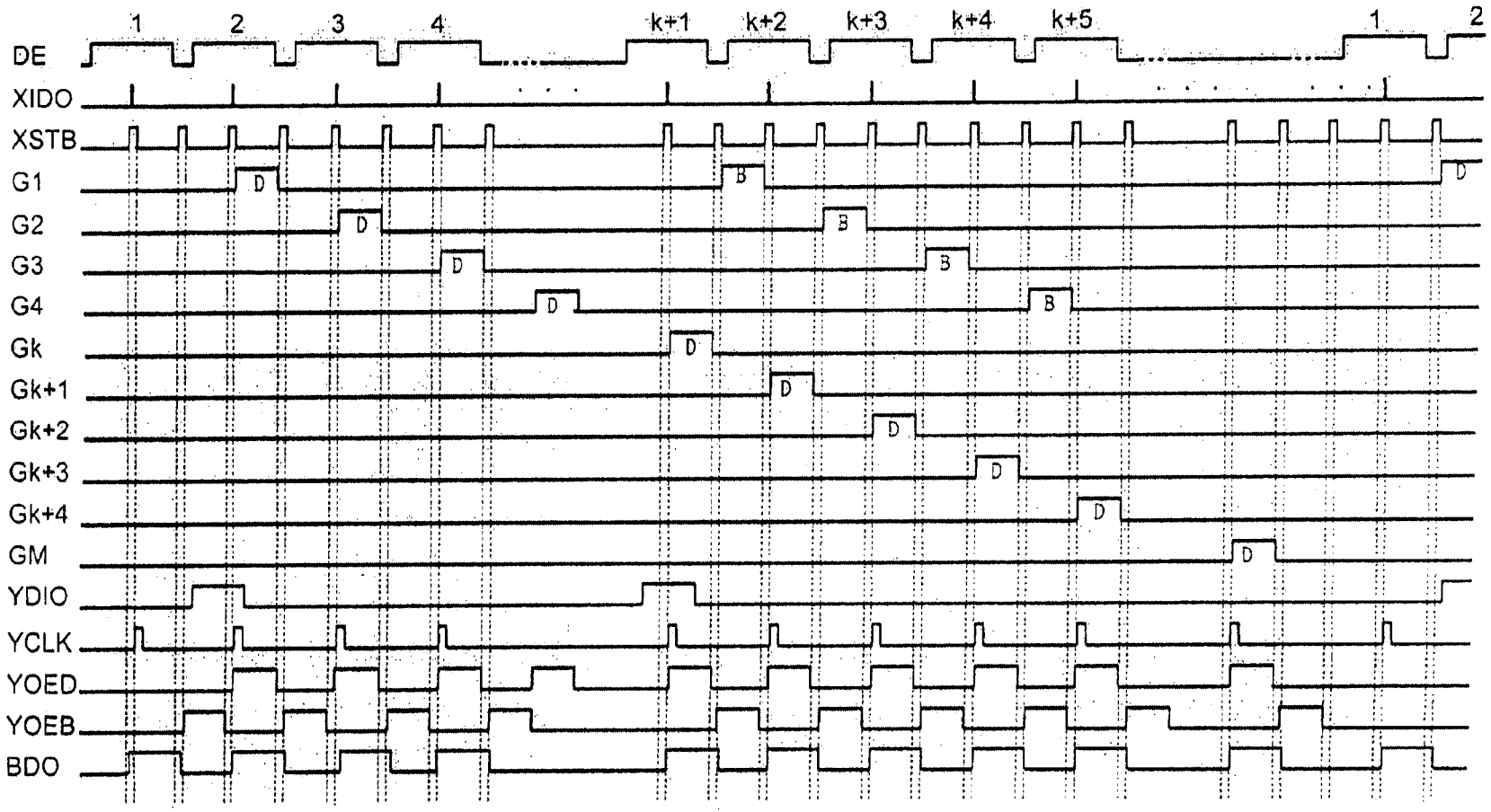
FIG. 4 is a timing chart showing various signals associated with the driving of pixels in the lines and the charging and discharging of the pixels in the lines within a frame.

FIG. 4 is a timing chart illustrating the signals in individual lines. In FIG. 4, DE denotes the Data Enable signal for each of the 768 lines. XDIO denotes the source input pulse in a scanning circuit for driving each of the gate lines associated with the scanning circuit. G1, G2, . . . , G(k+n) . . . denote the scanning signal lines in which the gate pulses D are sequentially provided in synchronization with the YOED pulses. The YOED pulses are triggered by the y clock signals YCLK. It should be noted that the pulse sequence in YOEB as shown in FIG. 3 lags behind the pulse sequence in YOED by the time period of k lines. For example, if k is 383 as shown in FIG. 3, then the first pulse in the YOEB sequence starts after the first pulse of the YOED sequence has passed for a time period of 383 lines. Thus, the second gate pulse B in any gate line lags behind the gate pulse D in the same gate line.

In FIG. 4, XSTB denotes an output pulse sequence from the scanning circuit, which is associated with the source input pulse sequence XDIO. The source input pulses XDIO are in synchronization with the source drive signal BDO, which is a special signal provided to the source driver. If BDO is high when the XSTB has a rising edge, the source driver outputs a predetermined low-brightness value in response to the XSTB falling edge. If BDO is low when XSTB has a rising edge, then the source driver outputs a normal image data in response the XSTB falling edge. Furthermore, after the rising edge of the YDIO which signals the start the scanning of a frame, each of the odd-numbered XSTB pulses marks the start of charging time for the pixels in a certain line, and the following even-number XSTB pulse marks the start of discharging time for the pixels in the same line.

Figure 5:
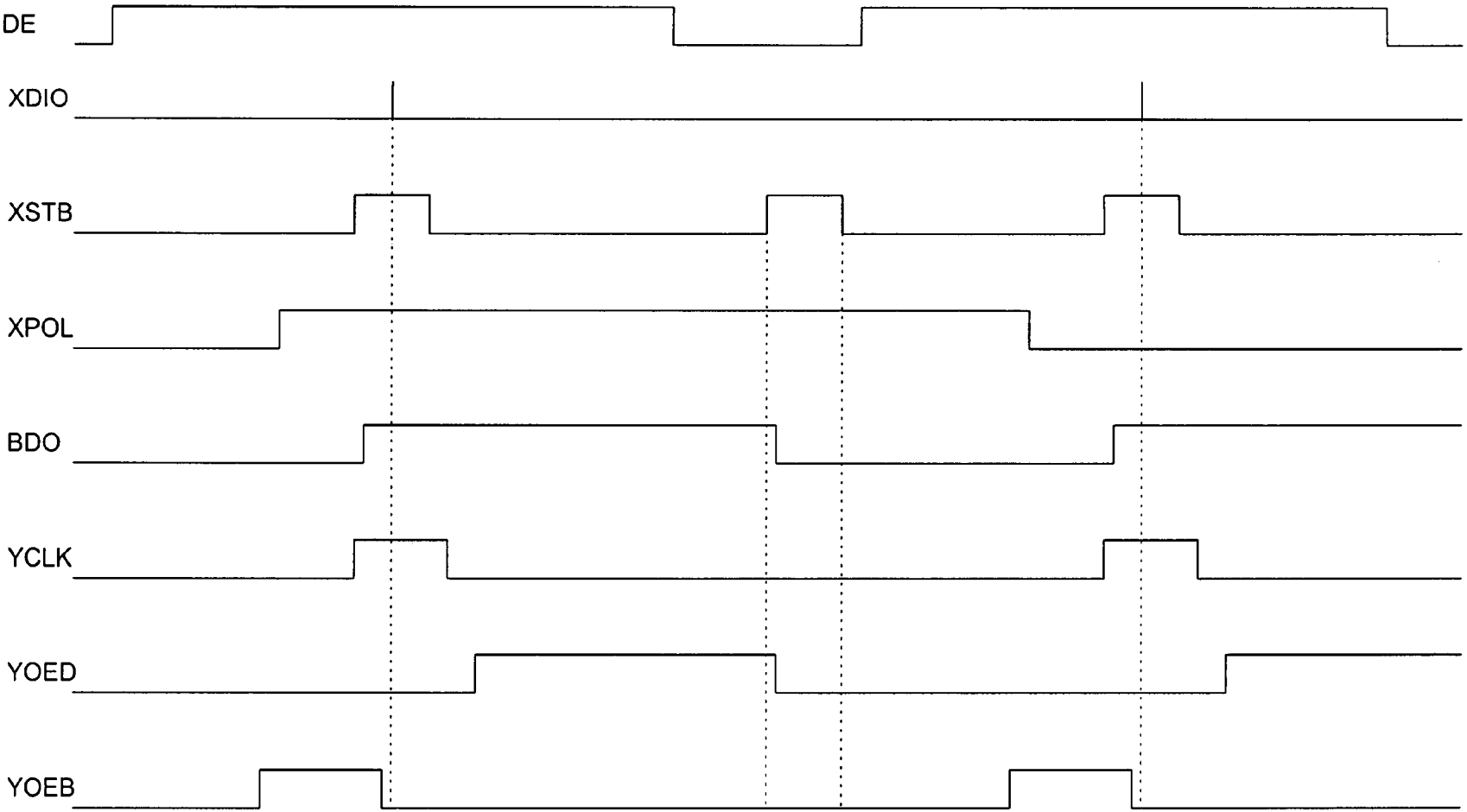
FIG. 5 is a timing chart showing various signals between two lines.

The timing of various signal pulses between two frames is illustrated in FIG. 3, whereas the timing of various signal pulses between two lines is illustrated in FIG. 5. In FIG. 5, XPOL denotes a polarization signal for a "swing" type display. If XPOL is high when XSTB has a rising edge, the Vcom signal (not shown) provided to the first pixel in response to the XSTB falling edge is positive. Vcom is voltage on a common line in a liquid crystal display panel. As mentioned earlier, each of the odd-numbered XSTB pulses marks the start of charging time for the pixels in a certain line, and the following even-number XSTB pulse marks the start of discharging time for the pixels in the same line. The timing for charging (rising) and discharging (falling) is associated with the increase and decrease of luminance in a pixel. Thus, the area under the charging and discharging curve is related to the total luminance produced by a pixel within a frame time. The charging and discharging of a pixel is illustrated in FIG. 6.

Figure 6:
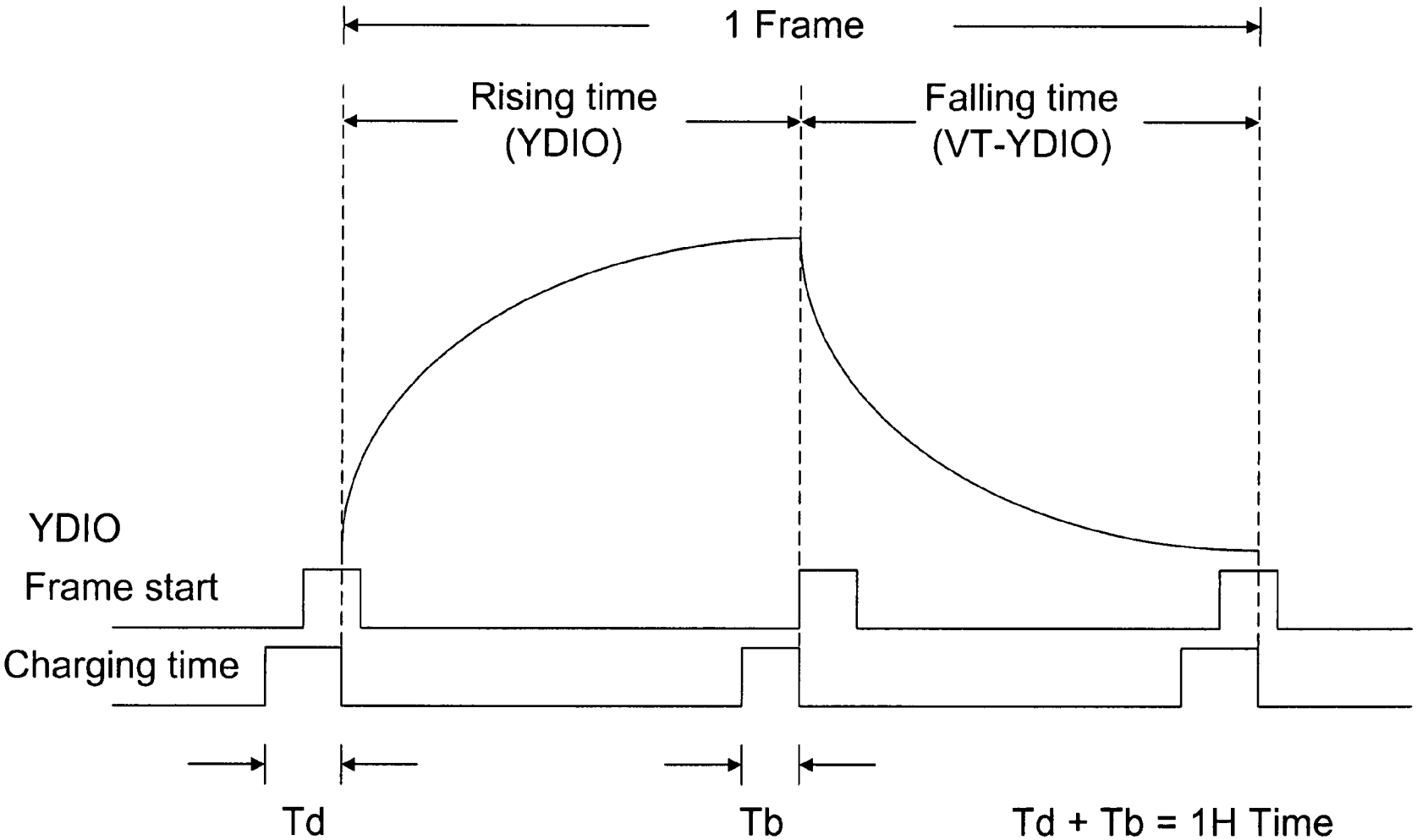
FIG. 6 is a plot showing the charging and discharging of the pixels in a line so as to increase the luminance for display and to decrease the luminance for inserting a darker frame portion.

As can be seen from FIG. 6, the first YDIO signal starts charging the pixels in gate line G1 while the second YDIO signal (VT-YDIO) starts discharging the pixels in the same gate line. The VT-YDIO signal starts the time periods for the corresponding darker frame portions. In that respect, the YDIO and the VT-YDIO are set for adjusting the temporal separation between a displayed frame portion and the corresponding darker frame portion. In FIG. 6, Td is the adjustable signal for rising data charging and Tb is for falling data discharging. The sum of Td and Tb is substantially equal to one horizontal line time (Td+Tb=1 H time). The horizontal time is defined as the active time of one DE signal (see FIGS. 4 and 5).

Figure 7:
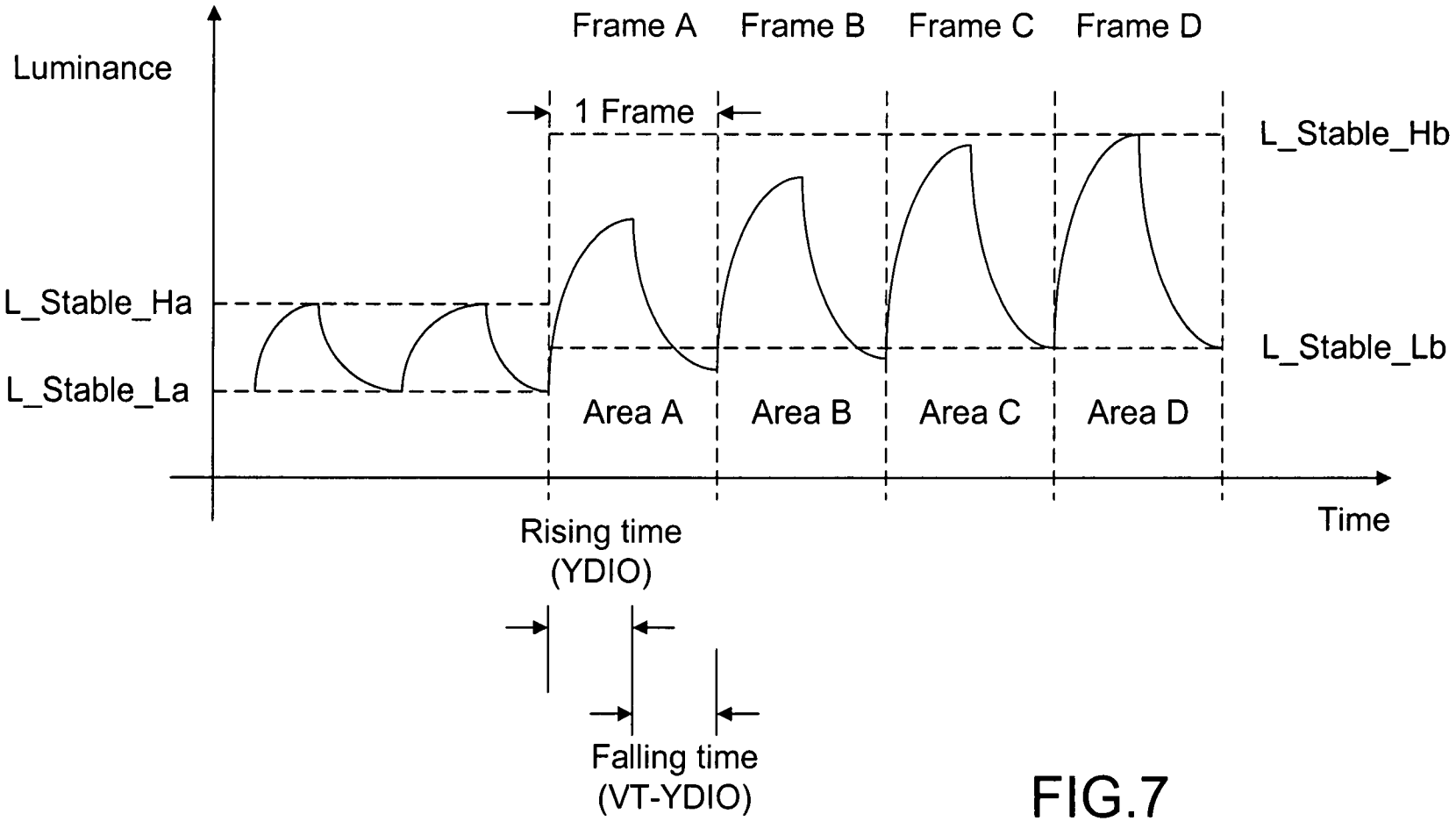
FIG. 7 shows the shape of the typical luminance curves between a luminance change.

It should be noted that, the temporal separation between an even-numbered YDIO pulse (discharging signal) and the preceding odd-numbered YDIO pulse (charging signal) is adjustable so that the increase and decrease of luminance in a pixel in a line within a frame time can be adjusted. When the luminance of a pixel changes from low to high, for example, the charging and discharging curve (see FIG. 6) for the first frame after the luminance change is usually different from the curve for the subsequent frames. Thus, the total luminance in the first frame is different from (and usually lower than) the total luminance in each of the subsequent frames, as shown in FIG. 7. As shown in FIG. 7, the total luminance in each of frames A, B, C and D is denoted as Area A, Area B, Area C and Area D, respectively. As can be seen in FIG. 7, Area A is smaller than Area B, which is smaller than Area C.

The luminance will become stable after a few frames. As illustrated in FIG. 7, Area C is substantially equal to Area D. When the luminance becomes stable, its peak is substantially equal to L_Stable_H, and the lowest luminance is substantially equal to L_Stable_L. In FIG. 7, the luminance in the first two frames is in response to image data Gray 16, and the luminance in the following four frames is in response to image data Gray 128, for example. However, after the transition from the low Gray value to the high Gray value, the luminance does not reach its stable state immediately. As such, the artifact of motion blur may occur. In FIG. 7, L_Stable_Ha and L_Stable_La denote the highest and lowest luminance values for Gray 16 and L_Stable_Hb and L_Stable_Lb denote the highest and lowest luminance values for Gray 128.

According to the present invention, an image data adjustment circuit (see FIG. 9) is used to adjust the luminance of the first few frames after a luminance change so as to reduce the total-luminance difference between one frame to another. As such, the motion blur effect can also be reduced. In general, the adjustment is to increase the image data for these first few frames so that the luminance appears to reach its stable state immediately.

Figure 8A:
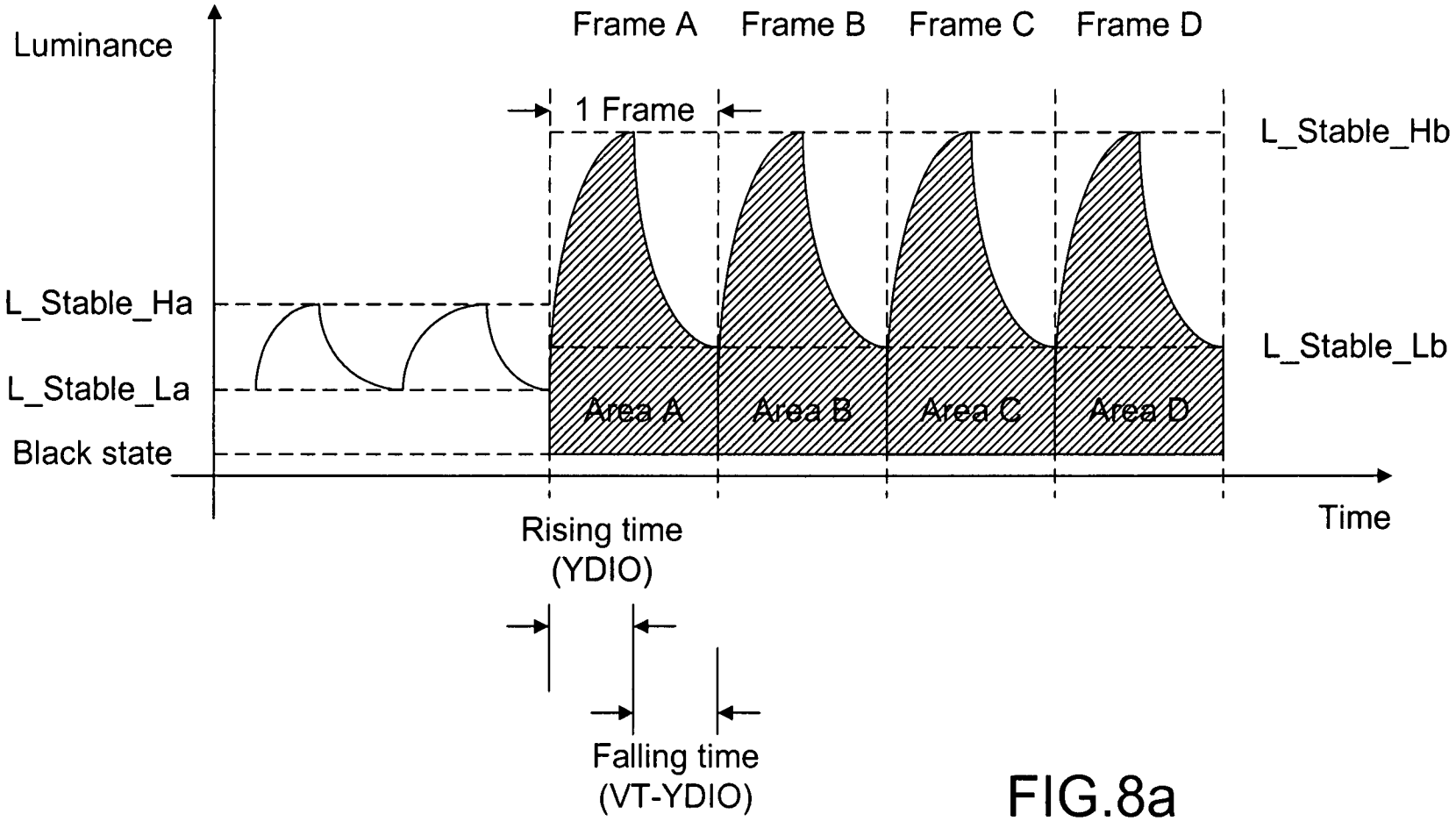
FIG. 8*a* is a schematic representation of an embodiment of the present invention.

In the first embodiment of the present invention, the image data adjustment circuit increases the luminance in the first few frames after a luminance change such that the total luminance of a pixel in each of these first few frames is substantially equal to the total luminance of the same pixel in a later frame after the luminance has reached its stable state, as shown in FIG. 8*a*.

Figure 8B:
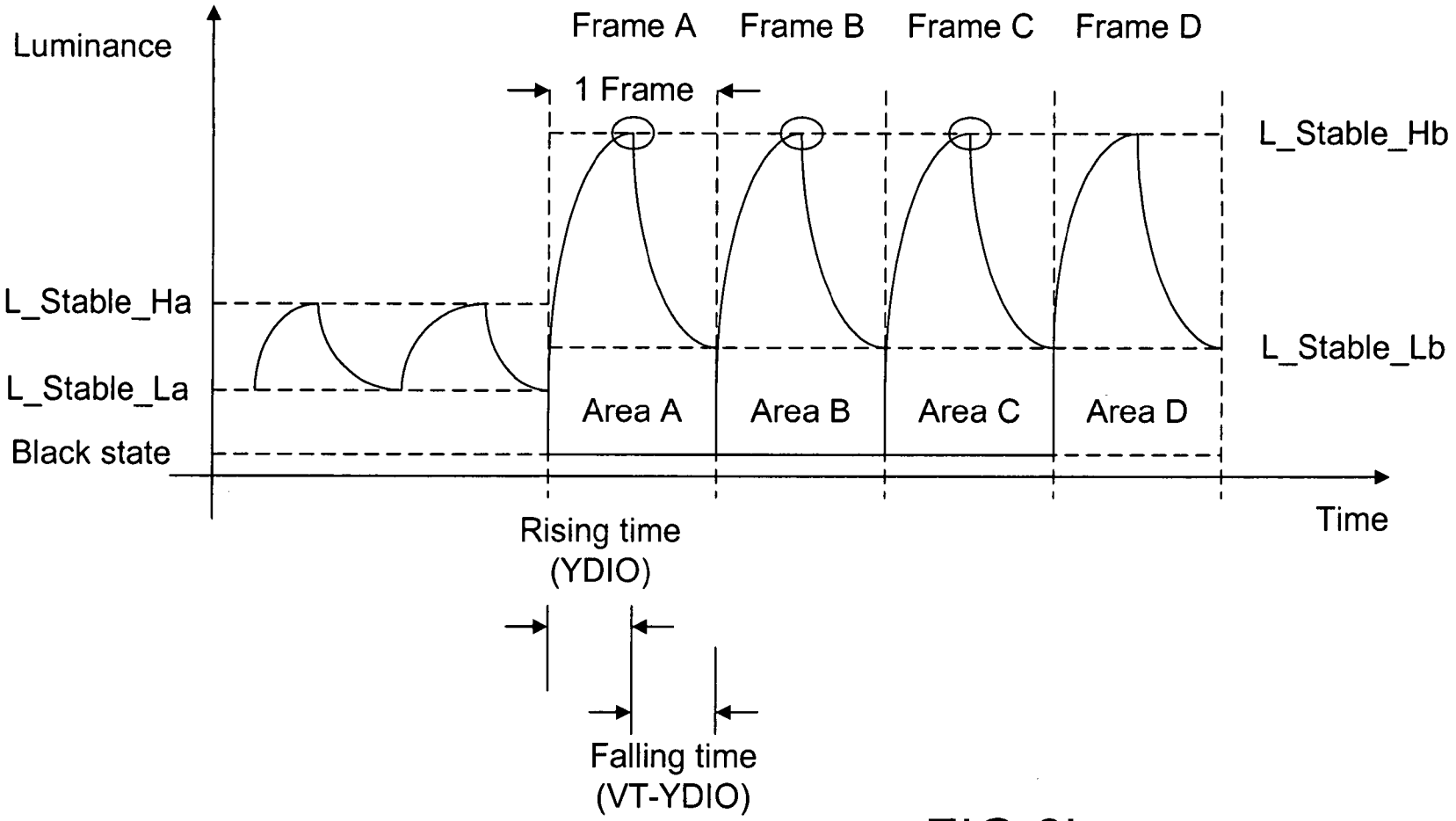
FIG. 8*b* is a schematic representation of another embodiment of the present invention.
Figure 8C:
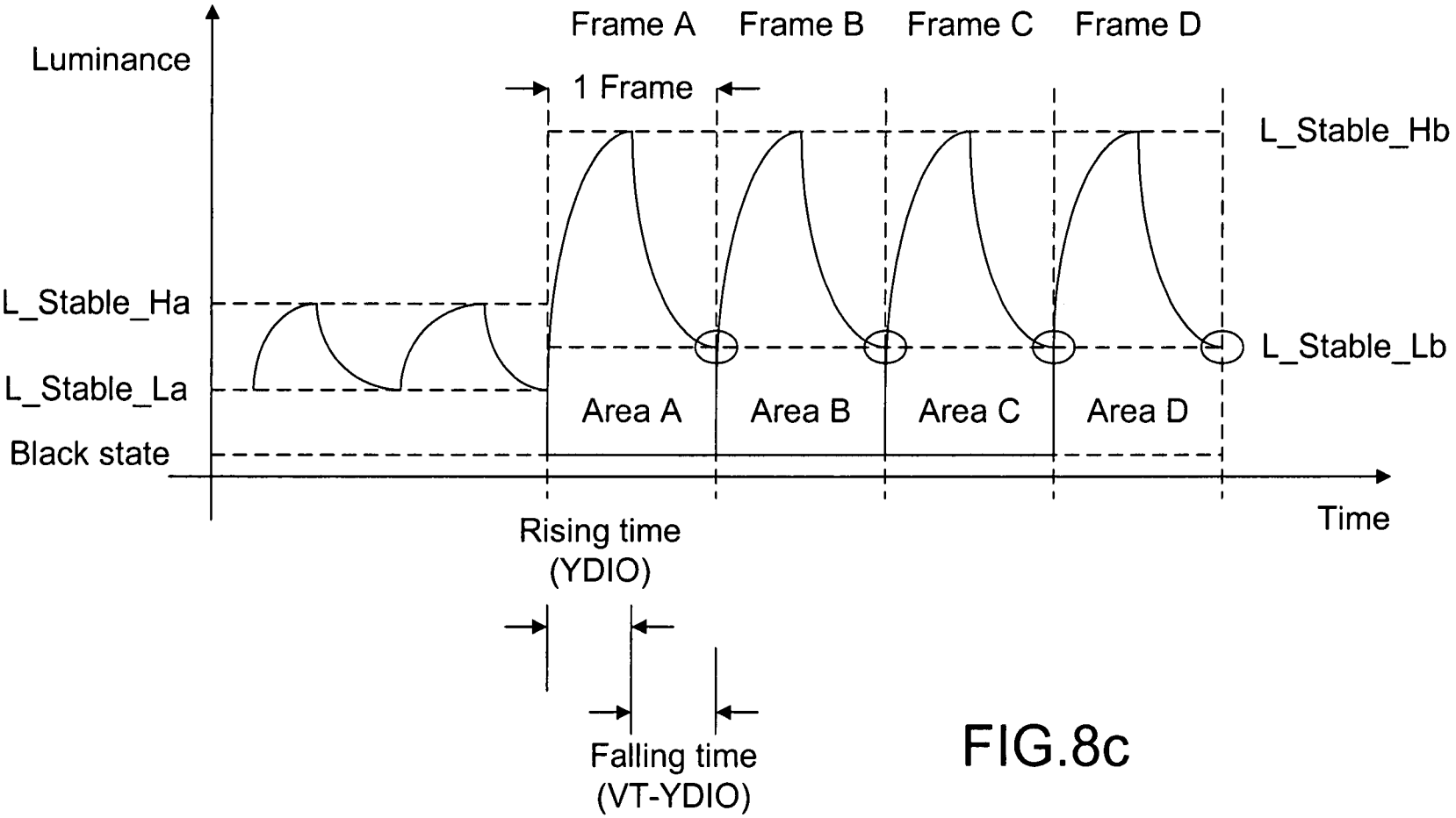
FIG. 8*c* is a schematic representation of a different embodiment of the present invention.
Figure 8D:
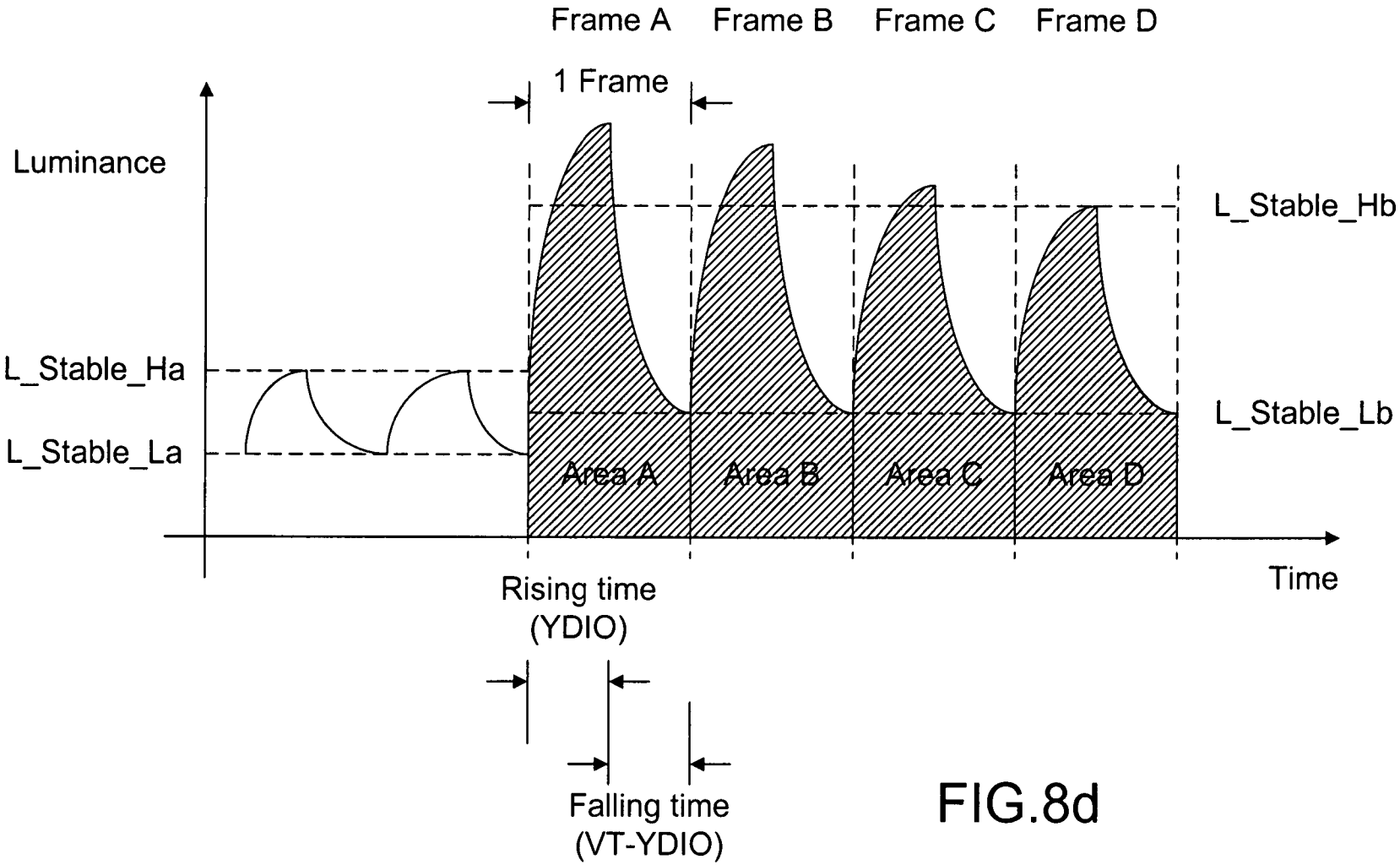
FIG. 8*d* is a schematic representation of yet another embodiment of the present invention.

In FIG. 8*a* and FIG. 8*d*, the total luminance is represented by the area under the luminance curve such that the following relationship holds:

$$\text{Area A} \geq \text{Area B} \geq \text{Area C} \geq \text{Area D},$$

where Area D represents the total luminance in the stable state without image data adjustment.

In the second embodiment of the present invention, the image data adjustment circuit increases the luminance in the first few frames after a luminance change such that the peak luminance of a pixel in each of these first few frames is substantially equal to the peak luminance of the same pixel in a later frame after the luminance has reached a stable state. The number of frames that are needed for image data adjustment to increase the luminance depends on the reaction time of the liquid crystal and the charge storage in the pixels. In general, the increase in luminance in 4 or 5 frames may be sufficient. However, that number of frames can be smaller or greater. As shown in FIG. 8*b*, the peak luminance in each of frames A, B and C is equal to the peak luminance in frame D. The peak luminance in frame D represents the peak luminance in the stable state, or L_Stable_H, without image data adjustment.

In the third embodiment of the present invention, the image data adjustment circuit increases the luminance in the first few frames after a luminance change such that the lowest point in luminance of a pixel in each of these first few frames is substantially equal to the L-Stable-L, the lowest luminance of the same pixel in the stable state, as shown in FIG. 8*c*.

In the fourth embodiment of the present invention, the image data adjustment circuit increases the luminance of the first few frames after a luminance change such that the peak luminance of a pixel in these first few frames is higher than the L_Stable_H, as shown in FIG. 8*d*.

Thus, according to the above-described embodiments of the present invention, an image data adjustment circuit is used to adjust the data to a pixel after a luminance change so as to shorten the time for the changed luminance to reach its stable state. In general, the data is increased for a first few frames after the luminance change. Furthermore, the total luminance in a frame can be adjusted by changing the temporal separation between the first YDIO signal and the second YDIO signal (VT-YDIO) within a frame time. The total luminance in a frame can also be adjusted by changing the charging time Td and the discharging time Tb.

Figure 9:
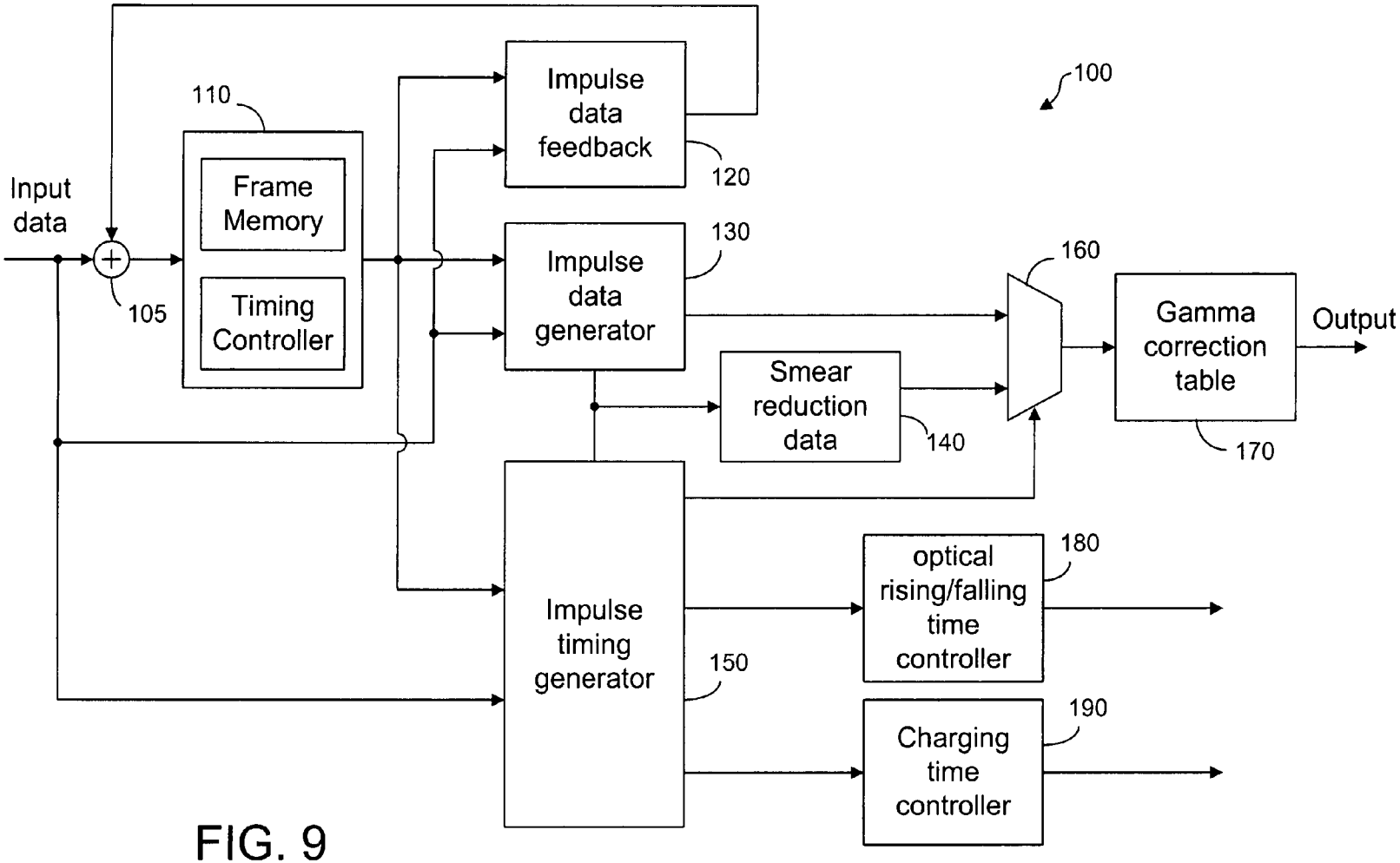
FIG. 9 is a block diagram showing a timing control unit to achieve the driving method, according to the present invention.

The motion blur reduction method of the present invention can be achieved by using an image data adjustment circuit 100 as shown in FIG. 9, for example. After the input data is received from a video card and processed to suit the display panel, the processed input data is stored in a frame memory in the frame memory controller 110. The frame memory controller 110 has two interconnected parts: frame memory and a timing controller for converting processed input data into a suitable form for storage. Furthermore, the stored data in the frame memory can be converted into a suitable form to be used by the timing controller. When the stored input data is retrieved from the frame memory controller, it is conveyed to an Impulse Timing Generator block 150, an Impulse Data Generator block 130 and an Impulse Data Feedback block 120. The Impulse Data Feedback block 120 is a feedback module which is used to process the data in a number of consecutive frames and to convey the processed data to a summing device 105 where the input data and the feedback processed data are subtracted or added before the summing result is stored in the frame memory.

The Impulse Timing Generator block 150 is adapted to compare the processed input data in the current frame with the processed input data in one or more previous frames and to provide an instructive signal based on such comparison. The instructive signal is conveyed to the Impulse Data Generator block 130, an Optical Rising/Falling Time Controller block 180 and a Charging Time Controller block 190. With the instructive signal, the blocks 130, 140, 180 and 190 decide how to reduce the motion blur depending on the function of the individual blocks. In particular, the Impulse Data Generator block 130 is used to provide output image data to the pixels. The data generator block 130 can be adapted to increase the data in a first few frames after a luminance change, for example. The Optical rising/falling time controller block 180 is used to provide the YDIO signals. The time controller block 180 can be adapted to shorten or lengthen the temporal separation between the first YDIO signal and the VT-YDIO signal within a frame time for a first few frames after a luminance change. The Charging Time Controller block 190 is used to provide the XSTB, YOED and XPOL controlling signals. For example, the time controller block 190 can be adapted to adjust the width of the XSTB pulses to control the charging and discharging time of the liquid crystal.

Advantageously, a Smear Reduction Data block 140 is also used to provide black or gray data insertion for motion blur reduction purposes, in addition to the luminance adjustment in the first few frames after a luminance change. When black or gray data is provided for insertion, a multiplexer 160 is used to insert the insertion data at the desirable frames, based on the instructive signal from the Impulse Timing Generator 150.

Moreover, a Gamma Correction Table 170 is used for gamma voltage selection, to make the data provided to the liquid crystal display with a form of impulse-like data display with correct gray level transparency and color temperature. In an impulse-like data display, a pixel appears to be turned on only at a portion of a frame time.

In brief, after the input data is received from a video card and processed to suit the display panel, the input data is stored in a frame memory in the frame memory controller. When the stored input data is retrieved from the frame memory controller, it is conveyed to the Impulse Timing Generator block so as to allow the Impulse Timing Generator block to compare the input data for the current frame with the input data in one or more previous frames. The data comparison result is indexed and conveyed to various controller blocks so as to allow the Optical rising/falling time control block to produce the YDIO signals and the Charging time controller block to produce the XSTB signals and the YOED signals. The produced signals can be adjusted for motion blur reduction purposes. In addition, black or gray data insertion can be used to reduce the motion blur and the gamma control table can be used to modify the impulse-type display data with correct gamma output.

In sum, the present invention provides a method and device for driving an active matrix display having a plurality of pixels, wherein image data is provided to the pixels for producing luminance in the pixels in a first period of a frame time, and the image data is at least partially removed in a following second period in order to reduce the luminance in the pixels, and wherein the sum of the first period and the second period is less than or substantially equal to one frame time.

In particular, the pixels are arranged in a plurality of lines and the lines are driven repetitively for forming the display image in a plurality of frame times, wherein the plurality of frame times comprise a first group of frame times and a following second group of frame times. If the total luminance in the pixels in the first period is lower than the total luminance in the pixels in the second group, the image data provided to the first group of frame times is adjusted so as to increase the total luminance in the first group of frame times.

Alternatively, at least the first period in the first group of frame times is lengthened so as to increase the total luminance in said pixels in the first group of frame times.

Alternatively, the charging time in the first period in the first group of frame times is adjusted so as to increase the total luminance in said pixels in the first group of frame times.

In another embodiment, where the luminance in the first period has a maximum luminance and the luminance in the second period has a minimum luminance, and the maximum value in said pixels in the first group is lower than the luminance in said pixels in the second group, the image data provided to the pixels in the first group of frame times is adjusted so as to increase the maximum luminance in the pixels in the first group of frame times.

Alternatively, the image data provided to the pixels in the first group of frame times is adjusted so as to decrease the minimum luminance in said pixels in the first group of frame times.

Alternatively, the charging time in the first period in the first group of frame times is adjusted so as to increase the maximum luminance in said pixels in the first group of frame times.

Thus, although the present invention has been described with respect to one or more embodiments thereof, it will be understood by those skilled in the art that the foregoing and various other changes, omissions and deviations in the form and detail thereof may be made without departing from the scope of this invention.

What is claimed is:

1. A method for driving an active matrix display having a plurality of pixels, wherein the pixels are arranged in a plurality of lines for forming a display image and the lines are driven repetitively for forming the display image in a plurality of frame times, the plurality of frame times comprising a first group of frame times and a following second group of frame times, said method comprising:

providing image data to the pixels for producing luminance in the pixels based on the provided data in a first period of a frame time in the first group and in the first period of the frame time in the second group such that the luminance increases with time in the first period in each of the frame times in the first group and in the second group, and removing at least part of the provided data from the pixels after the first period in each of the frame times at least in the second group so as to reduce the luminance in said pixels in a second period following the first period such that the luminance decreases with time in the second period in each of the frame times in the second group, wherein the sum of the first period and the second period is less than or substantially equal to one frame time, wherein the first group has a first stable state defined by a first maximum value and a first minimum value such that when the first group reaches the first stable state, variation in luminance value in the frame times in the first group is limited between the first maximum value and the first minimum value, and the second group has a second stable state defined by a second maximum value and a non-zero second minimum value such that when the second group reaches the second stable state, maximum luminance value in the frame times in the second group increases to the second maximum value and minimum luminance value in the frame times in the second group increases to the second minimum value, and wherein the first maximum value is lower than the second maximum value and the second minimum value is higher than the first minimum value but lower than the first maximum value, wherein the second group of frame times comprises two or more front frame times followed by two or more subsequent frame times, wherein a sum of the luminance in the first period and the luminance in the second period yields a total luminance, and the total luminance in said pixels in the front frame times is lower than the total luminance in said pixels in the subsequent frame times, said method further comprising:

increasing the image data provided to said pixels in the front frame times such that the maximum luminance value in the front frame times increases to the second maximum value and the minimum luminance value in the front frame times increases to the second minimum value so as to increase the total luminance in each of said two or more front frame times in said pixels.

2. The method of claim 1, wherein the image data is adjusted such that the total luminance in each of said two or more front frame times in said pixels is substantially equal to the total luminance in the subsequent frame times in said pixels.

3. The method of claim 1 further comprising:

adjusting at least the first period in the front frame times so as to increase the total luminance in said pixels in the front frame times.

4. The method of claim 1, wherein the second group of frame times comprises two or more front frame times followed by two or more subsequent frame times, and wherein the luminance in said pixels in the first period is adjustable by a charging time, and wherein a sum of the luminance in the first period and the luminance in the second period yields a total luminance, and the total luminance in said pixels in the front frame times is lower than the total luminance in said pixels in the subsequent frame times, said method further comprising:

adjusting the charging time in the first period in the front frame times so as to increase the total luminance in said pixels in the front frame times.

5. An active matrix display having a plurality of data lines and a plurality of pixels operatively connected to the data lines to receive image data for producing luminance in the pixels, wherein the pixels are arranged in a plurality of lines for forming a display image and the lines are driven repetitively for forming the display image in a plurality of frame times, the plurality of frame times comprising a first group of frame times and a following second group of frame times, said display comprising:

a data source configured to provide the image data; and a data adjustment circuit configured to adjust the image data so that the image data is provided in the first period of the frame time at least in the second group such that the luminance increases with time in the first period, and at least part of the provided data is removed from the pixels after the first period in each of the frame times at least in the second group so as to reduce the luminance in said pixels in a second period following the first period such that the luminance decreases with time in the second period in each of the frame times in the second group, wherein the sum of the first period and the second period is less than or substantially equal to one frame time, wherein the first group has a first stable state defined by a first maximum value and a first minimum value such that when the first group reaches the first stable state, variation in luminance value in the frame times in the first group is limited between the first maximum value and the first minimum value, and the second group has a second stable state defined by a second maximum value and a nonzero second minimum value such that when the second group reaches the second stable state, maximum luminance value in the frame times in the second group increases to the second maximum value and minimum luminance value in the frame times in the second group increases to the second minimum value, and wherein the first maximum value is lower than the second maximum value and the second minimum value is higher than the first minimum value but lower than the first maximum value, wherein the second group of frame times comprises two or more front frame times followed by two or more subsequent frame times, and wherein a sum of the luminance in the first period and the luminance in the second period yields a total luminance, and the total luminance in said pixels in the front frame times is lower than the total luminance in said pixels in the subsequent frame times wherein the data adjustment circuit is adapted to increase the image data provided to said pixels in the front frame times such that the maximum luminance value in the front frame times increases to the second maximum value and the minimum luminance value in the front frame times increases to the second minimum value so as to increase the total luminance in each of said two or more front frame times in said pixels and the image data is increased such that the total luminance in each of said two or more front frame times in said pixels is substantially equal to the total luminance in the subsequence frame times in said pixels.

6. The display of claim 5, wherein the data adjustment circuit is adapted to further adjust at least the first period in the front frame times so as to increase the total luminance in said pixels in the front frame times.

7. The display of claim 5, wherein the second group of frame times comprises two or more front frame times followed by two or more subsequent frame times, and wherein the luminance in said pixels in the first period is adjustable by a charging time, and wherein a sum of the luminance in the first period and the luminance in the second period yields a total luminance, and the total luminance in said pixels in the front frame times is lower than the total luminance in said pixels in the subsequent frame tithes, wherein the data adjustment circuit is adapted to further adjust the charging time in the first period in the front frame times so as to increase the total luminance in said pixels in the front frame times.

8. The display of claim 5, comprising a liquid crystal display.

9. A data adjustment module for use in an active matrix display having a plurality of data lines and a plurality of pixels operatively connected to the data lines to receive image data for producing luminance in the pixels, wherein the pixels are arranged in a plurality of lines for forming display images in a plurality of frames in a plurality of frame times, the plurality of frame times comprising a first group of frame times and a following second group of frame times, said data adjustment module comprising:

a timing generator, adapted to compare the image data in a current frame with the input data in one or more previous frames, for providing a signal based on said comparing; and a timing controller for controlling the image data, based on the signal, such that the image data is provided to the pixels in a first period of a frame dine in the first group and in the first period of the frame time in the second group such that the luminance increases with time in the first period in each of the frame times in the first group and in the second group, and at least part of the image data is removed from the pixels in a second period of frame time following the first period in order to reduce the luminance in said pixels in the second period such that the luminance decreases with time in the second period in each of the frame times at least in the second group, wherein the sum of the first period and the second period is less than or substantially equal to one frame time, wherein the first group has a first stable state defined by a first maximum value and a first minimum value such that when the first group reaches the first stable state, variation in luminance value in the frame times in the first group is limited between the first maximum value and the first minimum value, and the second group has a second stable state defined by a second maximum value and a non-zero second minimum value such that when the second group reaches the second stable state, maximum luminance value in the frame times in the second group increases to the second maximum value and minimum luminance value in the frame times in the second group increases to the second minimum value, and wherein the first maximum value is lower than the second maximum value and the second minimum value is higher than the first minimum value but lower than the first maximum value, wherein the second group of frame times comprises two or more front frame times followed by two or more subsequent frame times, and wherein a sum of the luminance in the first period and the luminance in the second period yields a total luminance, and the total luminance in said pixels in the front frame times is lower than the total luminance in said pixels in the subsequent frame times, wherein the data adjustment module is adapted to increase the image data provided to said pixels in the front frame times so as to increase the total luminance in each of said two or more front frame times in said pixels, wherein the image data is increased such that the total luminance in each of said two or more front frame times in said pixels is substantially equal to the total luminance in the subsequent frame times in said pixels.

* * * * *